US009555274B1

(12) United States Patent
Cassidy et al.

(10) Patent No.: US 9,555,274 B1
(45) Date of Patent: Jan. 31, 2017

(54) SEAT ADJUSTMENT DEVICES AND EXERCISE APPARATUSES HAVING SEAT ADJUSTMENT DEVICES

(71) Applicant: Brunswick Corporation, Lake Forest, IL (US)

(72) Inventors: John Michael Cassidy, Otsego, MN (US); Jana Dorothy Hermanson, Zimmerman, MN (US)

(73) Assignee: Brunswick Corporation, Lake Forest, IL (US)

( * ) Notice: Subject to any disclaimer, the term of this patent is extended or adjusted under 35 U.S.C. 154(b) by 2 days.

(21) Appl. No.: 14/619,601

(22) Filed: Feb. 11, 2015

(51) Int. Cl.
*A63B 26/00* (2006.01)
*A63B 21/06* (2006.01)
*A63B 21/00* (2006.01)

(52) U.S. Cl.
CPC .... *A63B 21/00047* (2013.01); *A63B 2225/093* (2013.01)

(58) Field of Classification Search
CPC ..... A63B 21/00; A63B 21/0047; A63B 21/06; A63B 21/0601–21/0607; A63B 21/0615–21/0618; A63B 21/40; A63B 21/4027; A63B 21/4029
USPC ..... 482/92–108, 142
See application file for complete search history.

(56) References Cited

U.S. PATENT DOCUMENTS 6,071,216 A * 6/2000 Giannelli ..... A63B 21/159 482/100
6,142,917 A * 11/2000 Giannelli ..... A63B 23/03533 482/100
6,254,516 B1 * 7/2001 Giannelli ..... A63B 23/1209 482/100
6,287,243 B1 * 9/2001 Isom ..... A63B 21/078 482/104
7,364,535 B1 * 4/2008 Rosenow ..... A63B 21/4033 482/101
D612,437 S * 3/2010 Fenster ..... D21/675
D613,350 S * 4/2010 Fenster ..... D21/675
7,717,836 B1 * 5/2010 Miller ..... A63B 21/00 482/142
7,753,830 B1 * 7/2010 Marsh ..... A63B 21/078 482/104
7,874,615 B2 1/2011 Huyck et al.
8,496,297 B2 7/2013 Huyck et al.
RE44,992 E 7/2014 Fenster
8,864,635 B1 10/2014 Atwood et al.
(Continued)

OTHER PUBLICATIONS

Matrix, 2012, Videos-of-Use, <https://www.youtube.com/watch?v=-px7Ui64FfM>; <https://www.youtube.com/watch?y=5NBA6-IlXuM>; <https://www.youtube.com/watch?y=7aRIJZCXdeo>.*
(Continued)

*Primary Examiner* — Stephen Crow
*Assistant Examiner* — Garrett Atkinson
(74) *Attorney, Agent, or Firm* — Andrus Intellectual Property Law, LLP

(57) ABSTRACT

An exercise apparatus has a frame, a seat that is supported by the frame and a body support member that is supported by the frame. The seat extends at a seat angle relative to the frame. A seat adjustment device facilitates adjustment of the height of the seat with respect to the frame and causes adjustment of the seat angle when the height of the seat is adjusted.

19 Claims, 8 Drawing Sheets

(56) References Cited

U.S. PATENT DOCUMENTS

| | | | | |
|---|---|---|---|---|
| 2003/0092543 | A1* | 5/2003 | Giannelli | A63B 21/155 482/100 |
| 2005/0032614 | A1* | 2/2005 | Keiser | A63B 21/4029 482/142 |

OTHER PUBLICATIONS

Matrix, Chest Press, 2014, PDF Manual.*
Matrix, Shoulder Press, 2014, PDF Manual.*
Matrix, Pull Down Machine, 2014, PDF Manual.*

* cited by examiner

SEAT ADJUSTMENT DEVICES AND EXERCISE APPARATUSES HAVING SEAT ADJUSTMENT DEVICES

FIELD

The present disclosure relates to exercise apparatuses.

BACKGROUND

The following U.S. Patents are incorporated herein by reference in entirety.

U.S. Pat. No. 8,864,635 discloses a resistance training exercise apparatus that includes a boom arm pivotally mounted to a flame and having an anchor segment pivoting along a first arc about a first pivot point on the frame. A press arm is coupled to a resistance mechanism and is pivotally mounted to the anchor segment of the boom arm and pivots along a second arc about a second pivot point. The user may adjustably vary the location of the second pivot point of the press arm relative to the frame by pivoting the boom arm about the first pivot point.

U.S. Pat. No. 8,496,297 discloses several mechanisms for permitting a user to adjust the seat on a stationary exercise bicycle. The described mechanisms can be used to adjust the height of the seat or the fore and aft positioning of the seat on an upright type bicycle. Each of the described mechanisms can be configured to provide users with an optimum seat position and with a convenient latch mechanism to adjust the position of the seat.

U.S. Pat. No. 7,874,615 discloses several mechanisms for permitting a user to adjust the seat on a stationary exercise bicycle. The described mechanisms can be used to adjust the height of the seat or the fore and aft positioning of the seat on an upright type bicycle. Each of the described mechanisms can be configured to provide users with an optimum seat position and with a convenient latch mechanism to adjust the position of the seat. Also described is a seat mechanism for use with a recumbent type stationary exercise bicycle where the seat can be adjusted along the longitudinal length of the bicycle.

U.S. Pat. No. 7,717,836 discloses exercise apparatus provided with a system for collapsing a user seat to a stow-away position. A user-engaged locking device releasably locks a bearing assembly and a seat frame at each of a user-exercise position and a stow-away position.

U.S. Pat. No. 7,364,535 discloses exercise apparatus having a biased tolerance-compensating engagement system between a seat-supporting carriage and a tubular support column to provide zero clearance between adjustment rollers and the support column, to minimize wobble during user adjustment.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

In certain examples, an exercise apparatus comprises a frame; a seat that is supported by the frame, wherein a user sits on the seat to perform an exercise activity; and a body support member that is supported by the frame, wherein the seat extends at a seat angle relative to the frame. The user abuts the body support member when the user is sitting on the seat to perform the exercise activity. The exercise apparatus further comprises a seat adjustment device that facilitates adjustment of the height of the seat with respect to the frame and causes adjustment of the seat angle when the height of the seat is adjusted.

In certain examples, a seat adjustment device is for an exercise apparatus having a frame, a seat that is supported by the frame at a seat angle, wherein a user sits on the seat to perform an exercise activity, and a body support member that is supported by the frame. The seat adjustment device comprises an upper support arm having a first end that is pivotably coupled to the seat at an upper first pivot point and a second end that is pivotably coupled to the frame at an upper second pivot point; and a lower support arm having a first end that is pivotably coupled to the seat at a lower first pivot point and a second end that is pivotably coupled to the frame at a lower second pivot point. The upper first pivot point and the lower first pivot point are spaced apart from each other a first distance. The upper second pivot point and the lower second pivot point are spaced apart from each other a second distance that is different than the first distance such that adjustment of the height of the seat with respect to the frame causes adjustment of the seat angle when the height of the seat is adjusted.

BRIEF DESCRIPTION OF THE DRAWINGS

Examples of seat adjustment devices and exercise apparatuses having seat adjustment devices are described with reference to the following drawing figures. The same numbers are used throughout the drawing figures to reference like features and components.

DETAILED DESCRIPTION OF THE DRAWINGS

Figure 1:
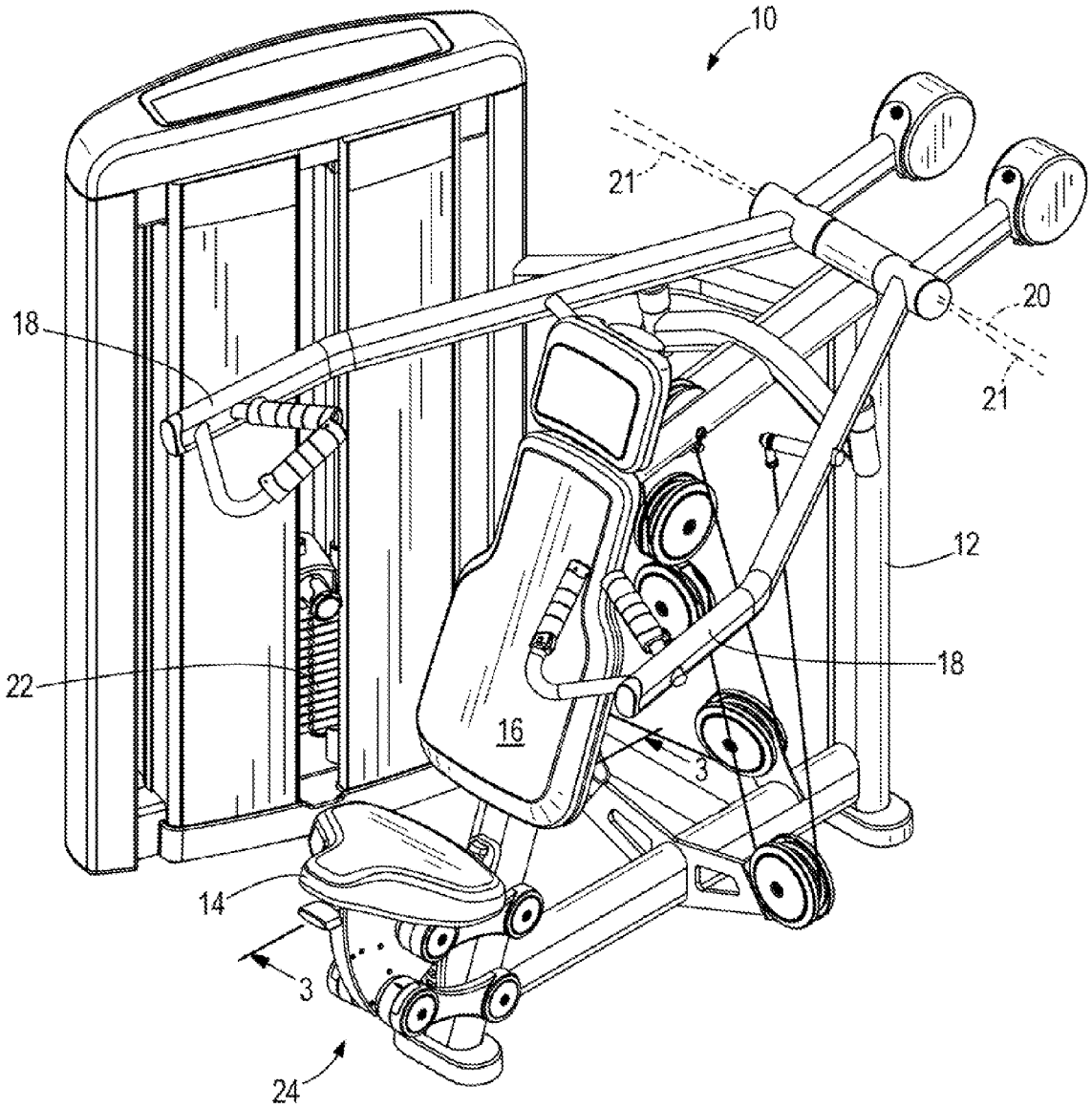
FIG. 1 is a perspective view of an exemplary exercise apparatus.

During research and development the present inventors identified several problems/drawbacks/disadvantages associated with prior art exercises apparatuses, and particularly with seat adjustment devices for exercise apparatuses. The inventors have found that known seat adjustment devices are not able to comfortably accommodate a wide range of users. For example, in vertically orientated upper body strength training apparatus, a user typically needs to vertically adjust the seat to properly align the user's body with the apparatus. That is, the input handles on the certain apparatuses (e.g. chest press apparatus, shoulder press apparatus, rowing apparatus, and/or the like) typically are located at a fixed height off the ground surface, such that a shorter user must raise the seat further off the ground surface than a taller user in order to be properly aligned with the apparatus. However this is counterproductive with respect to seat height ergonomics, where a shorter person requires a shorter seat height in order to keep their feet comfortably in contact with the ground surface. A competing factor from a user comfort stand point is the angle of the seat relative to the frame/ground surface/body support member (referred to herein below as the "seat angle"). Body support members (including for example back side supports or front side supports) and associated supporting frame members on upper body strength training apparatus typically are angled back from vertical about 10-20 degrees to provide a more comfortable and stable user position. Maintaining a seat angle in a range of about 90-100 degrees has been found to be optimal from the standpoint of user comfort and stability. Other body support members can include leg pads, foot pads, and/or the like. When the seat angle that is too flat (e.g. when the seat generally is horizontal, i.e. parallel to the ground surface) the user will tend to slip forward off of the seat.

Based upon the above realizations, the present inventors endeavored to provide seat adjustment devices for exercise apparatuses that cause the seat angle to articulate (change) as the height of the seat is changed with respect to the frame/body support member/ground surface. The inventors found that such a device advantageously can provide an optimal user position throughout an entire range of user heights. For example, on forward facing apparatuses (such as shoulder and/or chest press apparatuses and/or the like) when the seat is in its lowest position for use by a relatively tall user, the seat adjustment device can be configured to cause the seat to be angled closer to a 90 degree angle with respect to the frame/body support member. When the seat is in its highest position for use by a relatively shorter user, the seat adjustment device can be configured to cause the seat to be angled closer to horizontal (i.e. closer to parallel to the ground surface). For rearward facing apparatuses (e.g. pull-down apparatus), an angled seat position can be provided that makes it easier for a shorter user to maintain foot contact with the floor without having to straddle the seat pad as much. That is, the amount the user's legs pass through the top plane of the seat can be decreased, requiring less of a narrow nose on the seat to accommodate a wider range of user comfort. This advantageously allows for more optimal seat shape, allowing the seat pad to be more comfortable for a larger range of users.

FIGS. 1-5 and 6-8 depict examples of seat adjustment devices for forwardly facing exercise apparatuses and rearwardly facing exercise apparatuses, respectively. These examples are not limiting and the concepts of the present disclosure can be applied to different exercise apparatuses than what is shown.

FIG. 1 depicts an exercise apparatus 10, which in this example is a shoulder press apparatus having a frame 12 that supports a seat 14 and a body support member 16, which in this example is a back pad. The seat 14 and body support member 16 can include cushions/pads for comfortably supporting the user during exercise activity. In use, the user sits on the seat 14 and the body of the user abuts the body support member 16. In this example, the exercise activity is a shoulder press exercise and the back side of the user abuts the body support member 16. The press exercise utilizes a pair of articulable press arms 18, which are pivotally attached to the frame 12 along a pivot axis 20. In certain embodiments, the press arms 18 can also be configured to pivot independently about separate axes 21 to provide converging/diverging motion. The press arms 18 are connected to a weight stack 22 by a conventional cable and pulley system, which provide resistance during the exercise activity. The structure and function of the cable and pulley system is not germane to the scope of the present disclosure and can vary from which is shown and in certain examples can be any one of a number of conventional arrangements that are well known in the art, including one of the arrangements disclosed in the above-incorporated US patents. As such further description of the cable and pulley system and operation of the press arms 18 with respect to the weight stack 22 is not provided herein, for brevity sake.

Figure 2:
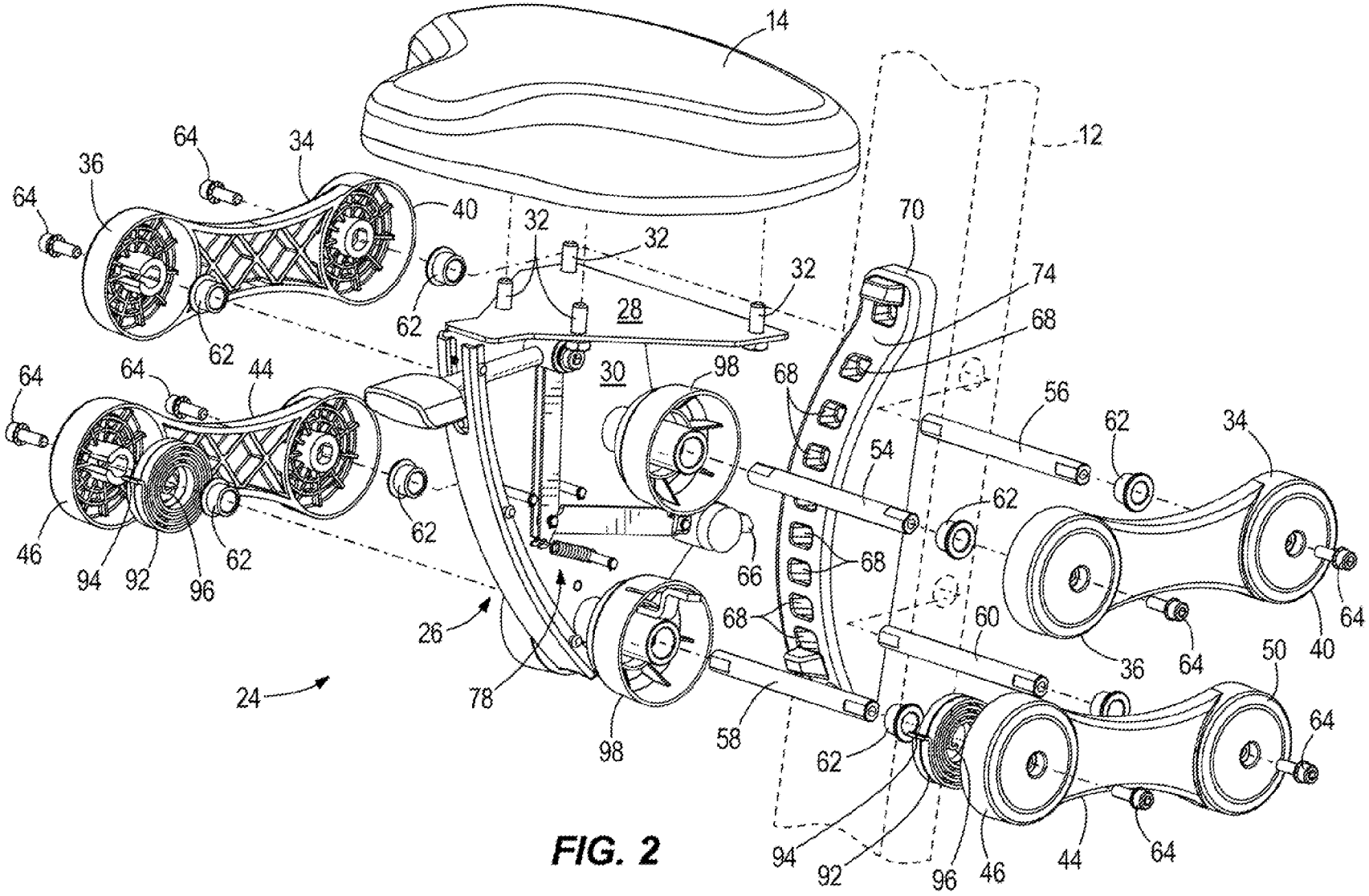
FIG. 2 is an exploded view of an exemplary seat adjustment device for the exercise apparatus shown in FIG. 1.

FIG. 2 depicts one example of a seat adjustment device 24 according to the present disclosure. The seat adjustment device 24 facilitates adjustment of the height of the seat 14 with respect to the frame 12 and ground surface, while at the same time causing adjustment of (i.e. change in) the seat angle A (see FIGS. 4 and 5) when the height of the seat 14 is adjusted. A supporting member 26 supports the seat 14. The supporting member 26 includes a support platform 28 that supports the seat 14 and a support base 30 that supports the support platform 28. The support platform 28 includes a plurality of bolts 32 that are received in the bottom surface of the seat 14 to secure the seat 14 with respect to the support platform 28. The support base 30 extends downwardly from the bottom of the support platform 28.

The seat adjustment device 24 includes a pair of upper support arms 34, each of which has a first end 36 that is pivotally coupled to the seat 14 at a movable upper first pivot point 38 and a second end 40 that is pivotally coupled to the frame 12 at a fixed upper second pivot point 42. The seat adjustment device 24 further has a pair of lower support arms 44, each of which has a first end 46 that is pivotally coupled to the seat 14 at a movable lower first pivot point 48 and a second end 50 that is pivotally coupled to the frame 12 at a fixed lower second pivot point 52. The type of pivotal connection can vary from that which is shown and can include any type of connection that allows pivoting movement between the respective members. In this example, referring to FIG. 2, an upper first pivot axle 54 extends between the pair of upper support arms 34 at the upper first pivot point 38. An upper second pivot axle 56 extends between the upper support arms 34 at the upper second pivot point 42. A lower first pivot axle 58 extends between the lower support arms 44 at the lower first pivot point 48. A lower second pivot axle 60 extends between the lower support arms 44 at the lower second pivot point 52. The upper first pivot axle 54, upper second pivot axle 56, lower first pivot axle 58, and lower second pivot axle 60 extend through holes in the support base 30 of the supporting member 26. Bushings 62 and bolts 64 support the ends of the respective pivot axles 54, 56, 58, 60 with respect to the support arms 34, 44.

Figure 3:
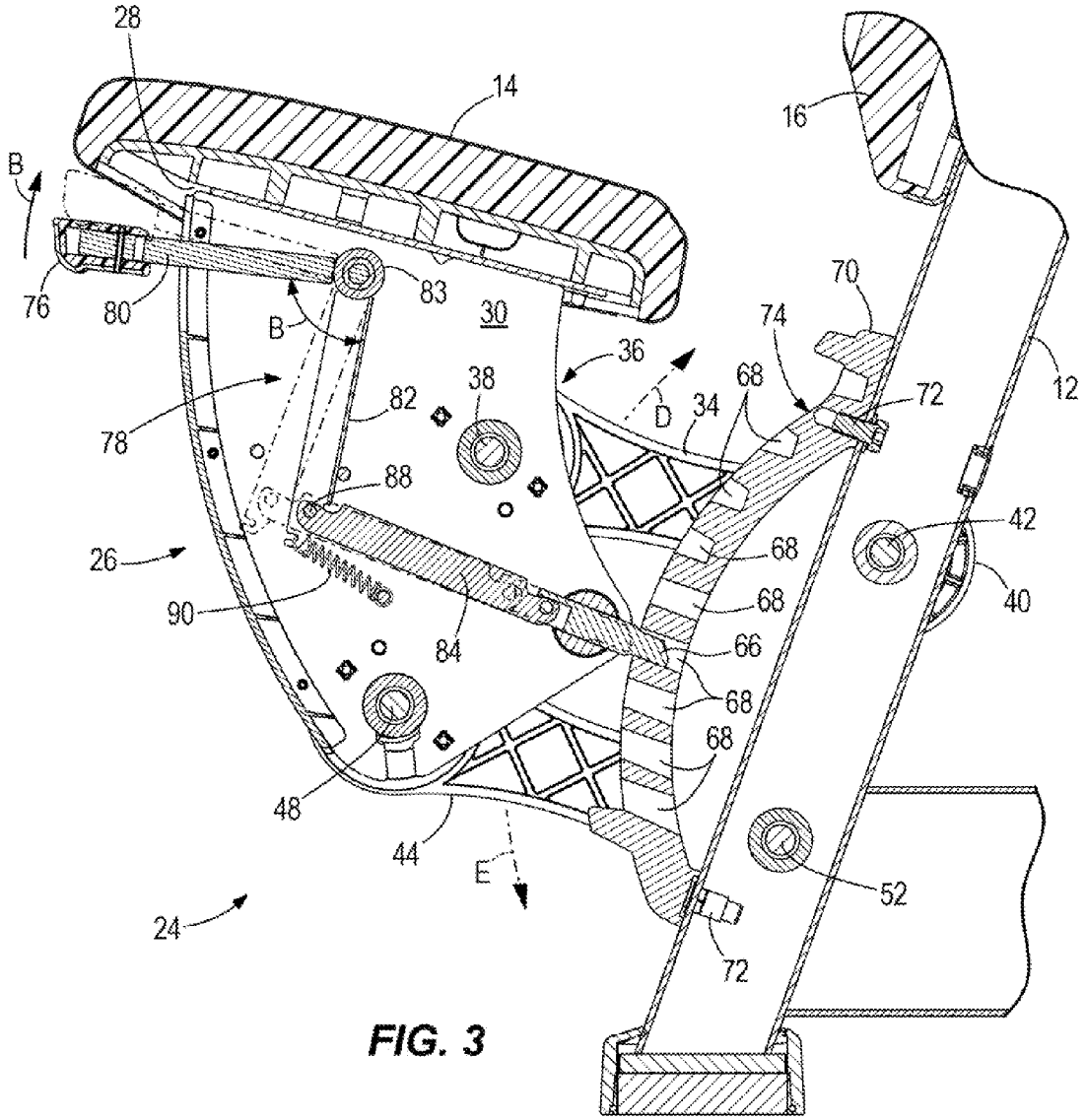
FIG. 3 is a side sectional view of the seat adjustment device shown in FIG. 2.

Referring to FIG. 3, the seat adjustment device 24 is manually operable and includes a pin 66 that is received in each of a plurality of slots 68 that are located at different heights with respect to the frame 12. In this example, the slots 68 are formed in a base member 70 that is fixed to the frame 12 by a pair of bolts 72. The base member 70 has a curved outer surface 74 and the slots 68 are vertically spaced apart along the curved outer surface 74, which faces the supporting member 26. A handle 76 is coupled to the pin 66 such that manually moving the handle 76 in the direction of arrow B removes the pin 66 from the slots 68. Manually releasing the handle 76 causes the handle 76 to move opposite the direction of arrow B and thus causes the pin 66 to engage with one of the slots 68. A linkage 78 connects the handle 76 to the pin 66. The linkage 78 includes a first link arm 80, a second link arm 82, and a third link arm 84. The first link arm 80 and the second link arm 82 can be formed as one piece or can be fixed together, for example by welding and/or the like. The first link arm 80 is connected to the second link arm 82 at a fixed pivot point 83 on the support base 30. The fixed pivot point 83 remains fixed with respect to the support base 30 and seat 14. The second link arm 82 is connected to the third link arm 84 at a movable pivot point 88 that is movable with respect to the support base 30 and seat 14. The pin 66 is connected to the third link arm 84 opposite the movable pivot point 88. The first link arm 80 transversely extends to the second link arm 82 at a fixed angle B. A spring 90 connects the linkage 78 to the support base 30 of the supporting member 26 and biases the pin 66 into engagement with one of the plurality of slots 68. As mentioned herein above, movement of the handle 76 in the direction of arrow B causes the first and second link arms 80, 82 to pivot together about the fixed pivot point 83, while the angle B remains constant. This is shown in dashed line format in FIG. 3. Such movement of the first and second link arms 80, 82 pulls on the spring 90, which is connected to the end of the second link arm 82 and also removes the pin 66 from the slot 68. Releasing the handle 76 allows the spring 90 to pull back on the end of the second link arm 82 and thus rotate the first and second link arms 80, 82 back into the position shown in solid line format in FIG. 3, as the pin 66 again registers into one of the slots 68, depending upon the vertical height of the seat 14.

As shown in FIG. 2, a pair of coil springs 92 are supported within the pair of lower support arms 44 at the lower first pivot point 48. Each coil spring 92 has a first end 94 that is connected to a fixed housing 98 on the support base 30 and a second end 96 that is connected to the lower support arm 44. The coil springs 92 tend to cause the lower support arms 44 to pivot in the direction of arrow D shown in FIG. 3, thus assisting movement of the seat 14 into a raised position. In use, the weight of the user sitting on the seat 14 acts against the bias force of the coil springs 92, thus causing movement of the seat in the direction of arrow E, shown in FIG. 3.

Figure 4:
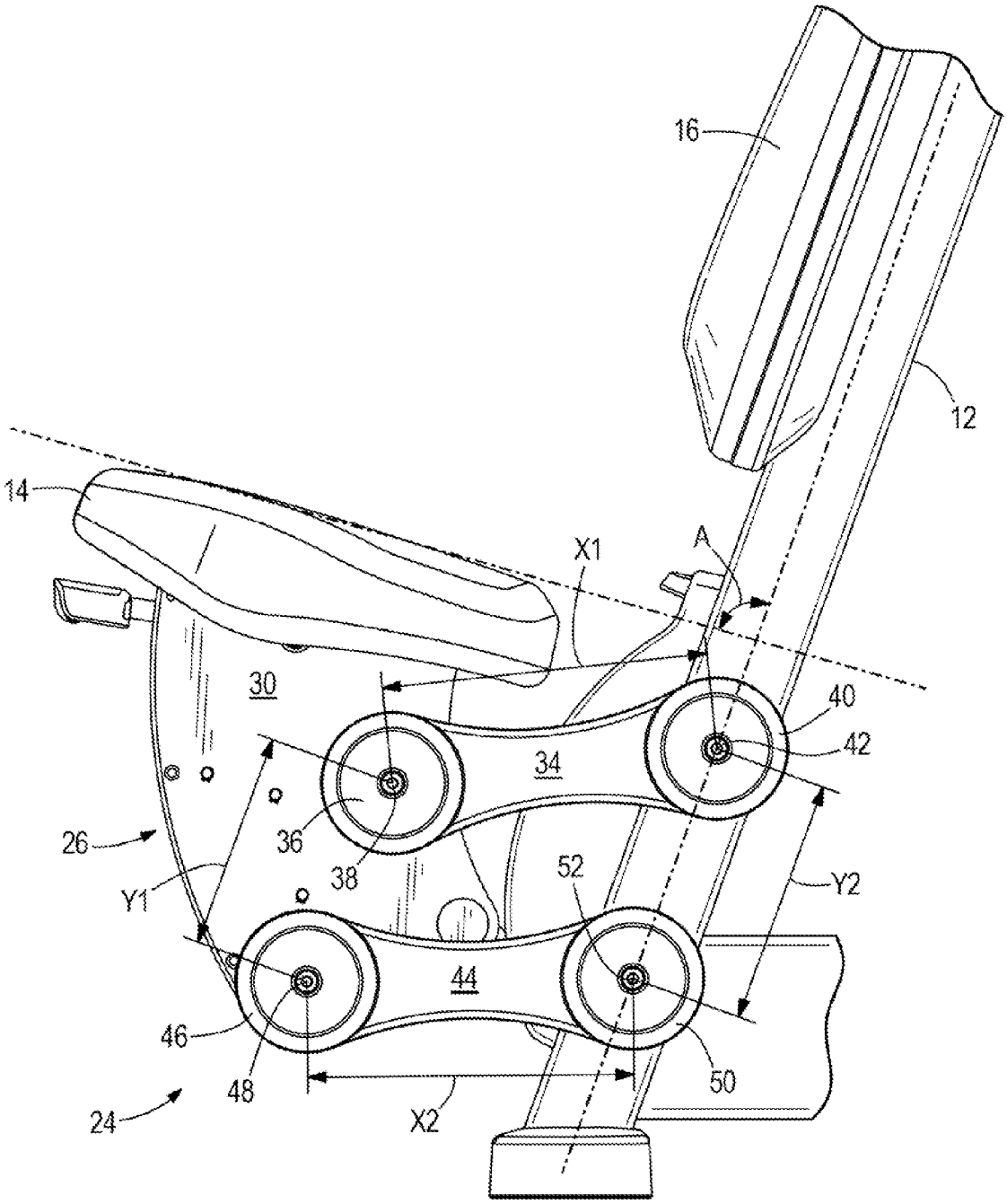
FIG. 4 is a side view of the seat adjustment device in a lowered position.
Figure 5:
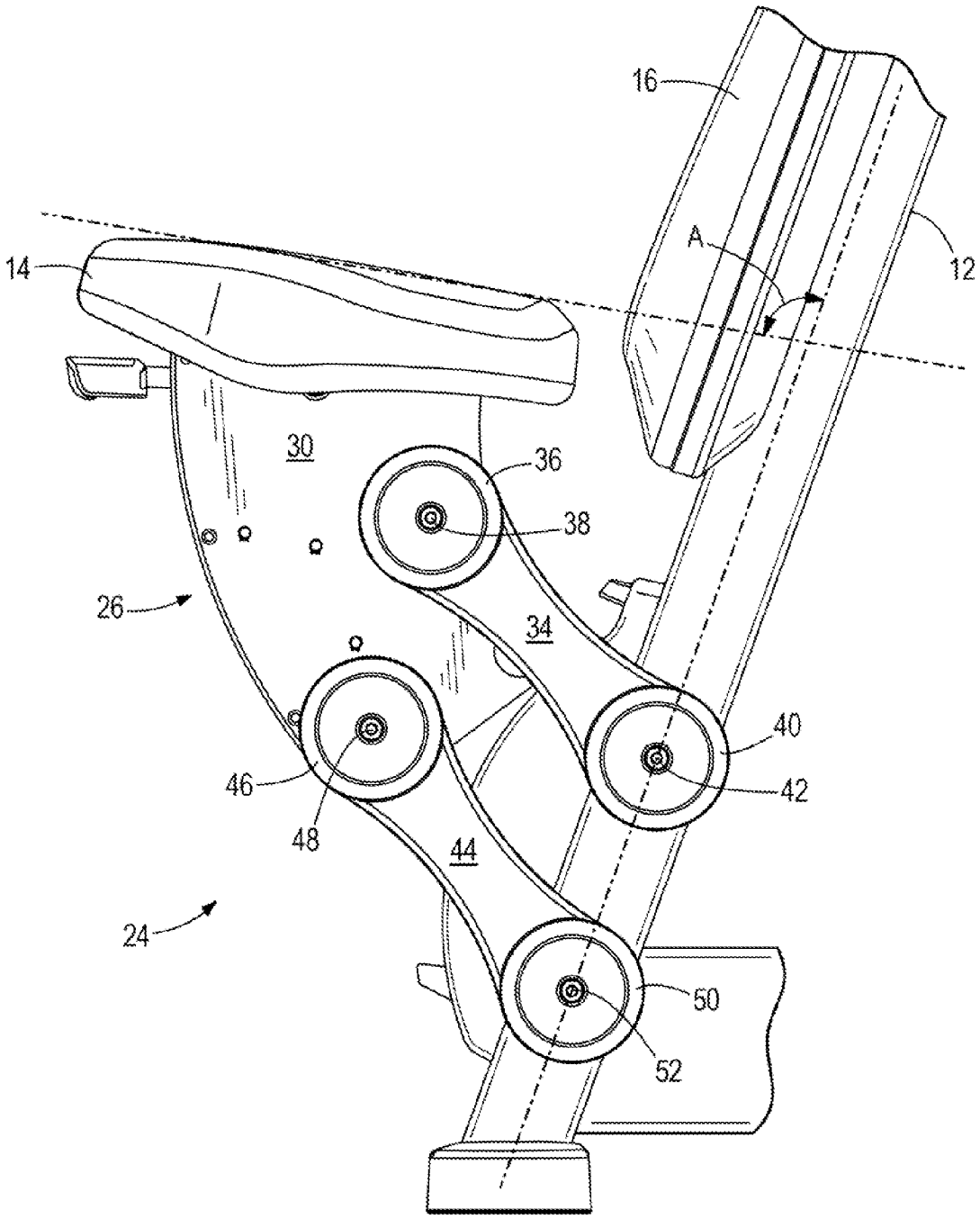
FIG. 5 is a side view of the seat adjustment device in a raised position.

FIG. 4 depicts the exercise apparatus 10 wherein the seat 14 is located in a lowered position. FIG. 5 depicts the exercise apparatus 10 wherein the seat 14 is located in a raised position. Comparison of FIGS. 4 and 5 illustrates that the seat adjustment device 24 facilitates adjustment of the height of the seat 14 with respect to the frame 12, body support member 16 and ground surface and also causes adjustment of the seat angle A when the height of the seat 14 is adjusted. More specifically, in this example, raising of the height of the seat 14 with respect to the frame 12 causes the seat adjustment device 24 to increase the seat angle A. Lowering of the height of the seat 14 with respect to the frame 12 causes the seat adjustment device 24 to decrease the seat angle A. This provides the advantages noted herein above regarding comfort and usability of users having different height characteristics.

Referring to FIG. 4, the upper first pivot point 38 and the lower first pivot point 48 are spaced apart from each other a first distance Y1. The upper second pivot point 42 and the lower second pivot point 52 are spaced apart from each other a second distance Y2 which is greater than the first distance Y1. The fact that the distances Y1. Y2 are different results in adjustments of the seat angle A when the height of the seat 14 is adjusted. The fact that Y2 is greater than Y1 causes the seat adjustment device 24 to increase the seat angle A when the height of the seat 14 is raised and decrease the seat angle A when the height of the seat 14 is lowered. In this example, the upper first pivot point 38 and the upper second pivot point 42 are spaced apart from each other at a third distance X1. The lower first pivot point 48 and the lower second pivot point 52 are spaced apart from each other at a fourth distance X2 can be equal to the third distance X1.

Figure 6:
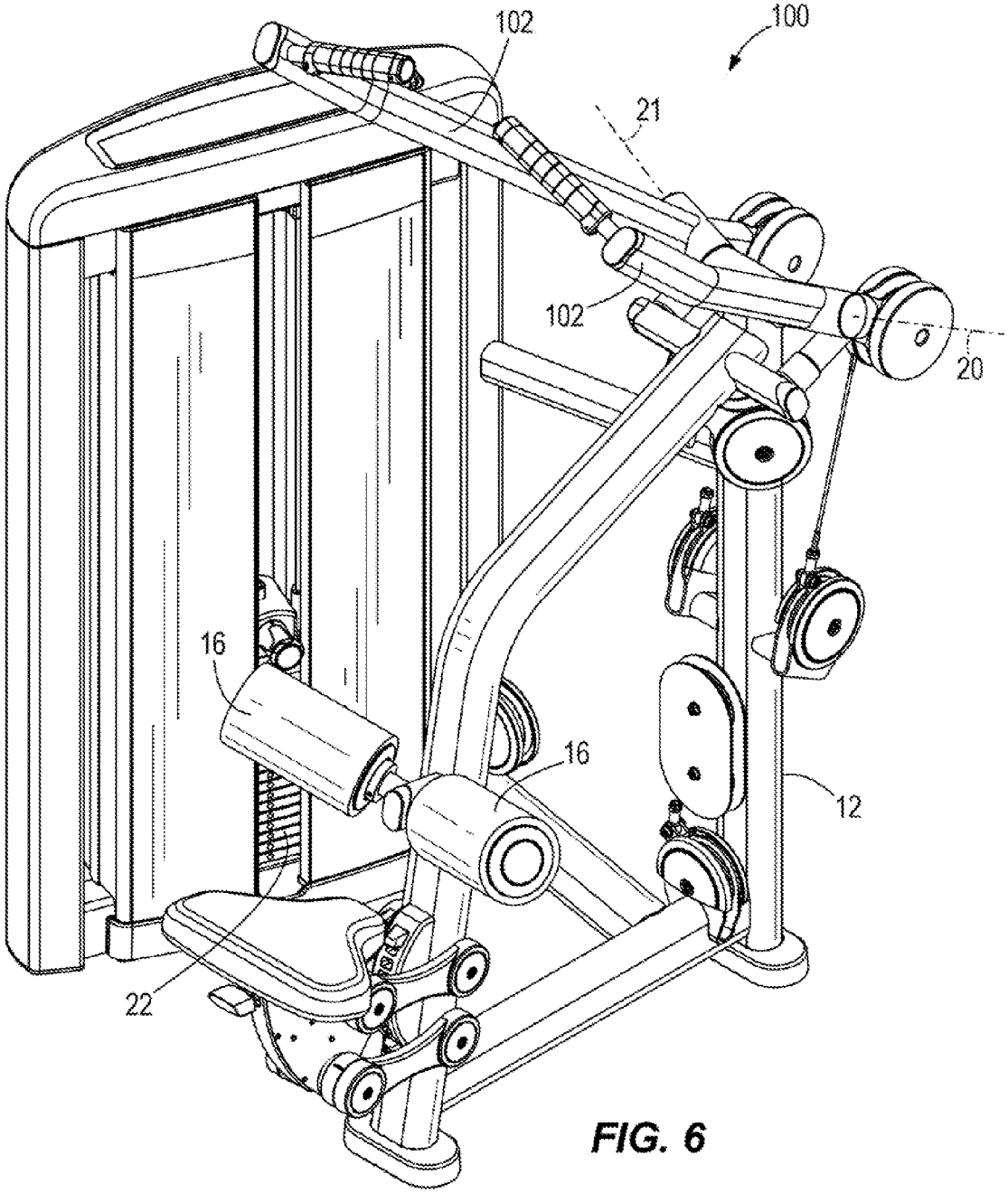
FIG. 6 is a perspective view of another exemplary exercise apparatus.
Figure 7:
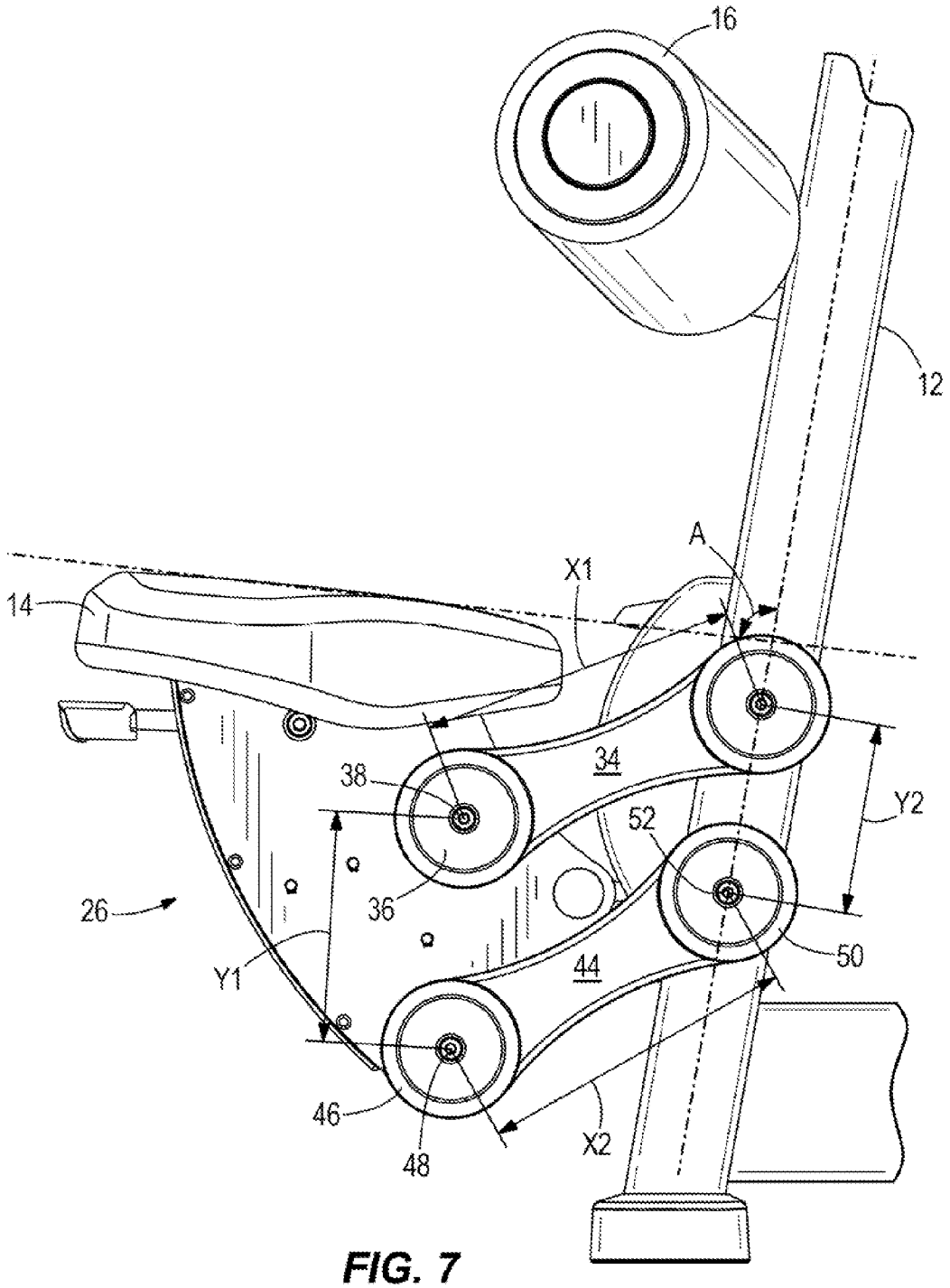
FIG. 7 is a side view of an exemplary seat adjustment device for the exercise apparatus shown in FIG. 6 in a lowered position.
Figure 8:
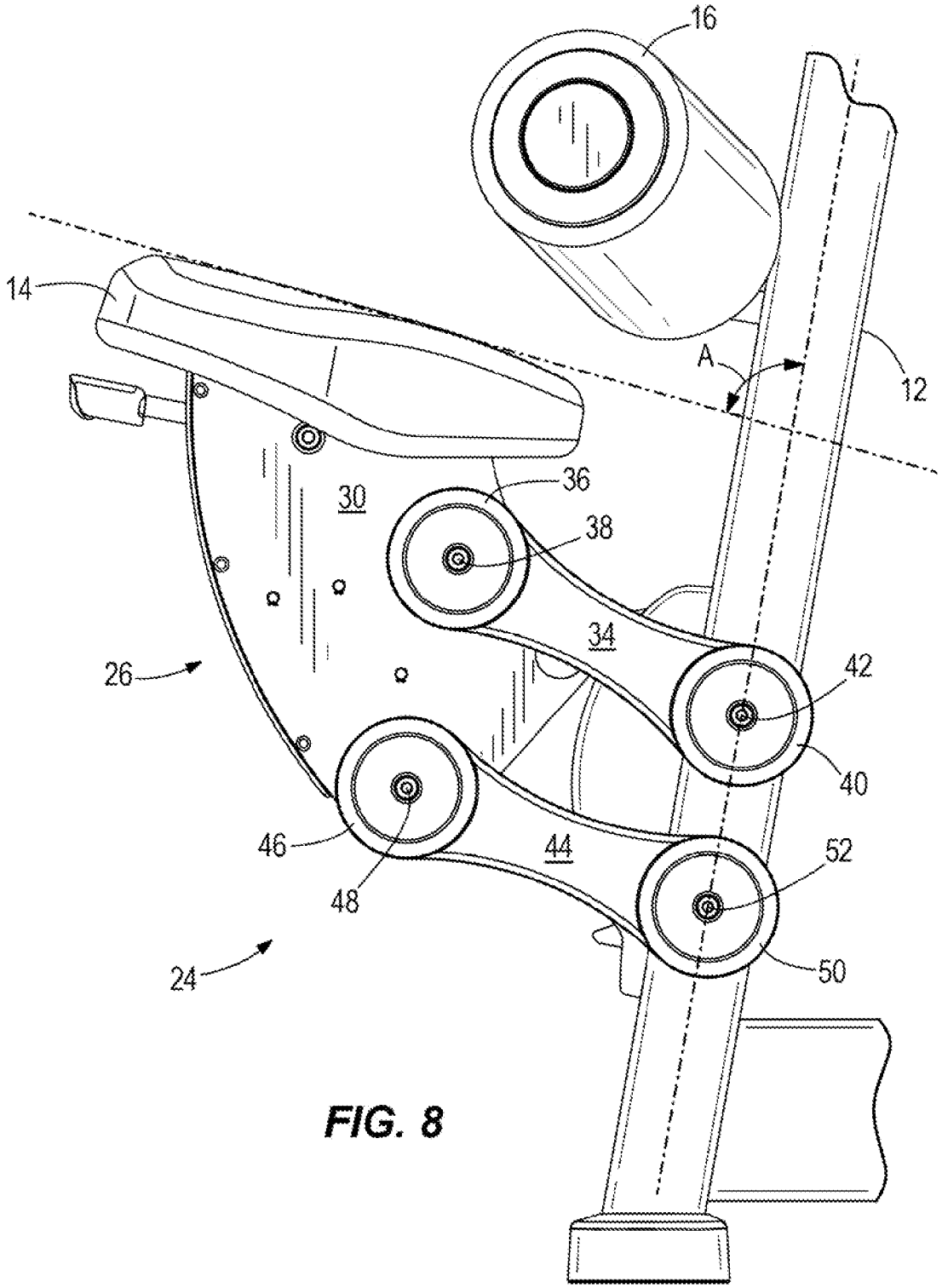
FIG. 8 is a side view of the seat adjustment device shown in FIG. 7 in a raised position.

FIGS. 6-8 depict another example of an exercise apparatus 100 having certain features that are similar to or the same as the exercise apparatus 10. Like reference numbers are used to reference the same and similar features. In the example of FIGS. 6-8, the apparatus 100 includes a pair of articulable pull-down arms 102 for performing an exercise activity including a pull-down exercise. In this example, the body support member 16 includes a pair of leg pads. In this example, the upper first pivot point 38 and the lower first pivot point 48 are spaced apart from each other a first distance Y1. The upper second pivot point 42 and the lower second pivot point 52 are spaced apart from each other a second distance Y2 that is less than the first distance. As such, raising the height of the seat 14 with respect to the frame 12 and ground surface causes the seat adjustment device 24 to decrease the seat angle A. Lowering of the height of the seat 14 with respect to the frame 12 and ground surface causes the seat adjustment device 24 to increase the seat angle A. This provides the advantages noted herein above regarding exercise apparatuses wherein the front of the body of the user engages the body support member 16.

In the present description, certain terms have been used for brevity, clearness, and understanding. No unnecessary limitations are to be inferred therefrom beyond the requirement of the prior art because such terms are used for descriptive purposes only and are intended to be broadly construed. The different assemblies described herein may be used alone or in combination with other apparatuses. Various equivalents, alternatives, and modifications are possible within the scope of the appended claims.

What is claimed is:

1. An exercise apparatus comprising:

a frame;

a seat that is supported by the frame, wherein a user sits on the seat to perform an exercise activity;

a body support member that is supported by the frame, wherein the seat extends at a seat angle relative to the body support member, and wherein the user abuts the body support member when the user is sitting on the seat to perform the exercise activity; and a seat adjustment device that facilitates adjustment of the height of the seat with respect to the frame and causes adjustment of the seat angle when the height of the seat is adjusted;

wherein a back side of the user abuts the body support member when the user is sitting on the seat to perform the exercise activity, and wherein the seat adjustment device is configured such that raising the height of the seat with respect to the frame while the body support member remains stationary causes the seat adjustment device to increase the seat angle and such that lowering the height of the seat with respect to the frame while the body support member remains stationary causes the seat adjustment device to decrease the seat angle;

wherein the apparatus comprises at least one articulatable press arm and wherein the exercise activity is a press exercise.

2. The apparatus according to claim 1, wherein the device comprises an upper support arm having a first end that is pivotably coupled to the seat at an upper first pivot point and a second end that is pivotably coupled to the frame at an upper second pivot point, wherein the device further comprises a lower support arm having a first end that is pivotably coupled to the seat at a lower first pivot point and a second end that is pivotably coupled to the frame at a lower second pivot point; wherein the upper first pivot point and the lower first pivot point are spaced apart from each other a first distance; and wherein the upper second pivot point and the lower second pivot point are spaced apart from each other a second distance that is greater than the first distance.

3. The apparatus according to claim 2, wherein the upper first pivot point and the upper second pivot point are spaced apart from each other at a third distance, and wherein the lower first pivot point and the lower second pivot point are spaced apart from each other at a fourth distance that is equal to the third distance.

4. An exercise apparatus comprising:

a frame;

a seat that is supported by the frame, wherein a user sits on the seat to perform an exercise activity;

a body support member that is supported by the frame, wherein the seat extends at a seat angle relative to the body support member, and wherein the user abuts the body support member when the user is sitting on the seat to perform the exercise activity; and a seat adjustment device that facilitates adjustment of the height of the seat with respect to the frame and causes adjustment of the seat angle when the height of the seat is adjusted;

wherein a front side of the user abuts the body support member when the user is sitting on the seat to perform the exercise activity, and wherein the seat adjustment device is configured such that raising the height of the seat with respect to the frame while the body support member remains stationary causes the seat adjustment device to decrease the seat angle and such that lowering the height of the seat with respect to the frame while the body support remains stationary causes the seat adjustment device to increase the seat angle;

wherein the apparatus comprises at least one articulatable pull-down arm and wherein the exercise activity is a pull-down exercise.

5. The apparatus according to claim 4, wherein the device comprises an upper support arm having a first end that is pivotably coupled to the seat at an upper first pivot point and a second end that is pivotably coupled to the frame at an upper second pivot point, wherein the device further comprises a lower support arm having a first end that is pivotably coupled to the seat at a lower first pivot point and a second end that is pivotably coupled to the frame at a lower second pivot point; wherein the upper first pivot point and the lower first pivot point are spaced apart from each other a first distance; and wherein the upper second pivot point and the lower second pivot point are spaced apart from each other a second distance that is less than the first distance.

6. The apparatus according to claim 5, wherein the upper first pivot point and the upper second pivot point are spaced apart from each other at a third distance, and wherein the lower first pivot point and the lower second pivot point are spaced apart from each other at a fourth distance that is equal to the third distance.

7. An exercise apparatus comprising a frame, a seat that is supported by the frame at a seat angle, wherein a user sits on the seat to perform an exercise activity, a body support member that is supported by the frame, and a seat adjustment device comprising:

an upper support arm having a first end that is pivotably coupled to the seat at an upper first pivot point and a second end that is pivotably coupled to the frame at an upper second pivot point, a lower support arm having a first end that is pivotably coupled to the seat at a lower first pivot point and a second end that is pivotably coupled to the frame at a lower second pivot point;

wherein the upper first pivot point and the lower first pivot point are spaced apart from each other a first distance; and wherein the upper second pivot point and the lower second pivot point are spaced apart from each other a second distance that is different than the first distance such that adjustment of the height of the seat with respect to the frame causes adjustment of the seat angle when the height of the seat is adjusted.

8. The apparatus according to claim 7, wherein the seat adjustment device is manually operable.

9. The apparatus according to claim 8, wherein the seat adjustment device comprises a pin that is received in a plurality of slots located at different heights with respect to the frame.

10. The apparatus according to claim 9, wherein the plurality of slots are formed in a base member that is fixed to the frame.

11. The apparatus according to claim 10, wherein the base member comprises a curved outer surface and wherein the plurality of slots are spaced apart along the curved outer surface.

12. The apparatus according to claim 9, further comprising a handle that is coupled to the pin, wherein pulling on the handle removes the pin from the plurality of slots and wherein releasing the handle causes the pin to engage with one of the plurality of slots.

13. The apparatus according to claim 12, further comprising a linkage that connects the handle to the pin, wherein the linkage comprises a first link arm, a second link arm, and a third link arm, wherein the first link arm is connected to the second link arm at a fixed pivot point that remains fixed with respect to the seat and wherein the second link arm is connected to the third link arm at a movable pivot point that moves with respect to the seat, and wherein the pin is connected to the third link arm.

14. The apparatus according to claim 13, wherein the first link arm extends transversely to the second link arm at a fixed angle.

15. The apparatus according to claim 14, comprising a spring that couples the linkage to the seat and biases the pin into engagement with the one of the plurality of slots.

16. The apparatus according to claim 7, comprising a supporting member that supports the seat, wherein the supporting member comprises a support platform that supports the seat and a support base that supports the support platform.

17. The apparatus according to claim 16, wherein the device comprises an upper support arm having a first end that is pivotably coupled to the seat at an upper first pivot point and a second end that is pivotably coupled to the frame at an upper second pivot point, wherein the device further comprises a lower support arm having a first end that is pivotably coupled to the seat at a lower first pivot point and a second end that is pivotably coupled to the frame at a lower second pivot point; and further comprising an upper first pivot axle at the upper first pivot point, an upper second pivot axle at the upper second pivot point, a lower first pivot axle at the lower first pivot point and lower second pivot axle at the lower second pivot point; wherein the upper first pivot axle, upper second pivot axle, lower first pivot axle and lower second pivot axle extend through the support base.

18. The apparatus according to claim 7, wherein the second distance is greater than the first distance such that raising the height of the seat with respect to the frame causes the seat adjustment device to increase the seat angle and wherein lowering the height of the seat with respect to the frame causes the seat adjustment device to decrease the seat angle.

19. The apparatus according to claim 7, wherein the second distance is less than the first distance such that raising the height of the seat with respect to the frame causes the seat adjustment device to decrease the seat angle and wherein lowering the height of the seat with respect to the frame causes the seat adjustment device to increase the seat angle.

* * * * *